US007747430B2

(12) United States Patent
Mäkinen

(10) Patent No.: US 7,747,430 B2
(45) Date of Patent: Jun. 29, 2010

(54) CODING MODEL SELECTION

(75) Inventor: Jari Mäkinen, Tampere (FI)

(73) Assignee: Nokia Corporation, Espoo (FI)

( * ) Notice: Subject to any disclaimer, the term of this patent is extended or adjusted under 35 U.S.C. 154(b) by 1488 days.

(21) Appl. No.: 11/065,717

(22) Filed: Feb. 23, 2005

(65) Prior Publication Data

US 2005/0192797 A1 Sep. 1, 2005

(30) Foreign Application Priority Data

Feb. 23, 2004 (FI) ..... 20045052

(51) Int. Cl.
*G10L 19/00* (2006.01)

(52) U.S. Cl. ..... 704/219

(58) Field of Classification Search ..... 704/200.1, 704/219

See application file for complete search history.

(56) References Cited

U.S. PATENT DOCUMENTS

| | | | | |
|---|---|---|---|---|
| 5,553,191 | A * | 9/1996 | Minde | 704/219 |
| 5,717,825 | A * | 2/1998 | Lamblin | 704/223 |
| 5,737,484 | A | 4/1998 | Ozawa | |
| 5,933,803 | A * | 8/1999 | Ojala | 704/223 |
| 6,134,518 | A | 10/2000 | Cohen et al. | |
| 6,311,154 | B1 | 10/2001 | Gersho et al. | |
| 6,510,407 | B1 * | 1/2003 | Wang | 704/207 |
| 6,539,355 | B1 * | 3/2003 | Omori et al. | 704/268 |
| 6,640,208 | B1 | 10/2003 | Zhang et al. | |
| 2002/0111797 | A1 | 8/2002 | Gao | |
| 2003/0009325 | A1 | 1/2003 | Kirchherr et al. | |
| 2003/0101050 | A1 | 5/2003 | Khalil et al. | |

FOREIGN PATENT DOCUMENTS

| | | |
|---|---|---|
| EP | 1278184 | 1/2003 |
| WO | WO 2005/081231 A1 | 9/2005 |

OTHER PUBLICATIONS

"A Wideband Speech and Audio Codec at 16/24/32 Kbit/s using Hybrid ACELP/TCX Techniques" by B. Bessette et al; Speech Coding Proceedings, 1999 IEEE Workshop Jun. 20-23, 1999; pp. 7-9.

(Continued)

*Primary Examiner*—Michael N Opsasnick

(57) ABSTRACT

The invention relates to an encoder (200) comprising an input (201) for inputting frames of an audio signal, a LTP analysis block (209) for performing a LTP analysis of the frames of the audio signal to form LTP parameters on the basis of the properties of the audio signal, and at least a first excitation block (206) for performing a first excitation for frames of the audio signal, and a second excitation block (207) for performing a second excitation for frames of the audio signal. The encoder (200) further comprises a parameter analysis block (202) for analysing said LTP parameters, and an excitation selection block (203) for selecting one excitation block among said first excitation block (206) and said second excitation block (207) for performing the excitation for the frames of the audio signal on the basis of the parameter analysis. The invention also relates to a device, a system, a method, a module and a computer program product.

52 Claims, 6 Drawing Sheets

OTHER PUBLICATIONS

"Advances in Speech Coding" by Bishnu S. Atal et al; 1991 Kluwer Academic Publishers, pp. 82-83, 146-147, 192-195, 216-221.
Korean Office Action dated Oct. 29, 2007, 4 pages English translation and 5 pages Korean original citing Bishnu et al and US 6,311,154 (previously) disclosed with argumentation by KIPO Examiner.
Ramprashad, Sean A., "The Multimode Transform Predictive Coding Paradigm," IEEE Transactions on Speech and Audio Processing, vol. 11, No. 2, Mar. 2003, XP011079700.

* cited by examiner

CODING MODEL SELECTION

FIELD OF THE INVENTION

The invention relates to audio coding in which encoding mode is changed depending on the properties of the audio signal. The present invention relates to an encoder comprising an input for inputting frames of an audio signal, a long term prediction (LTP) analysis block for performing an LTP analysis to the frames of the audio signal to form long term prediction (LTP) parameters on the basis of the properties of the audio signal, and at least a first excitation block for performing a first excitation for frames of the audio signal, and a second excitation block for performing a second excitation for frames of the audio signal. The invention also relates to a device comprising an encoder comprising an input for inputting frames of an audio signal, a LTP analysis block for performing an LTP analysis to the frames of the audio signal to form LTP parameters on the basis of the properties of the audio signal, and at least a first excitation block for performing a first excitation for frames of the audio signal, and a second excitation block for performing a second excitation for frames of the audio signal. The invention also relates to a system comprising an encoder comprising an input for inputting frames of an audio signal, a LTP analysis block for performing an LTP analysis to the frames of the audio signal to form LTP parameters on the basis of the properties of the audio signal, and at least a first excitation block for performing a first excitation for frames of the audio signal, and a second excitation block for performing a second excitation for frames of the audio signal. The invention further relates to a method for processing audio signal, in which an LTP analysis is performed to the frames of the audio signal for forming LTP parameters on the basis of the properties of the signal, and at least a first excitation and a second excitation are selectable to be performed for frames of the audio signal. The invention relates to a module comprising a LTP analysis block for performing an LTP analysis to frames of an audio signal to form LTP parameters on the basis of the properties of the audio signal. The invention relates to a computer program product comprising machine executable steps for encoding audio signal, in which an LTP analysis is performed to the frames of the audio signal for forming LTP parameters on the basis of the properties of the signal, and at least a first excitation and a second excitation are selectable to be performed for frames of the audio signal.

BACKGROUND OF THE INVENTION

In many audio signal processing applications audio signals are compressed to reduce the processing power requirements when processing the audio signal. For example, in digital communication systems audio signal is typically captured as an analogue signal, digitised in an analogue to digital (A/D) converter and then encoded before transmission over a wireless air interface between a user equipment, such as a mobile station, and a base station. The purpose of the encoding is to compress the digitised signal and transmit it over the air interface with the minimum amount of data whilst maintaining an acceptable signal quality level. This is particularly important as radio channel capacity over the wireless air interface is limited in a cellular communication network. There are also applications in which digitised audio signal is stored to a storage medium for later reproduction of the audio signal.

The compression can be lossy or lossless. In lossy compression some information is lost during the compression wherein it is not possible to fully reconstruct the original signal from the compressed signal. In lossless compression no information is normally lost. Hence, the original signal can usually be completely reconstructed from the compressed signal.

The term audio signal is normally understood as a signal containing speech, music (non-speech) or both. The different nature of speech and music makes it rather difficult to design one compression algorithm which works enough well for both speech and music. Therefore, the problem is often solved by designing different algorithms for both audio and speech and use some kind of recognition method to recognise whether the audio signal is speech like or music like and select the appropriate algorithm according to the recognition.

In overall, classifying purely between speech and music or non-speech signals is a difficult task. The required accuracy depends heavily on the application. In some applications the accuracy is more critical like in speech recognition or in accurate archiving for storage and retrieval purposes. However, the situation is a bit different if the classification is used for selecting optimal compression method for the input signal. In this case, it may happen that there does not exist one compression method that is always optimal for speech and another method that is always optimal for music or non-speech signals. In practise, it may be that a compression method for speech transients is also very efficient for music transients. It is also possible that a music compression for strong tonal components may be good for voiced speech segments. So, in these instances, methods for classifying just purely for speech and music do not create the most optimal algorithm to select the best compression method.

Often speech can be considered as bandlimited to between approximately 200 Hz and 3400 Hz. The typical sampling rate used by an A/D converter to convert an analogue speech signal into a digital signal is either 8 kHz or 16 kHz. Music or non-speech signals may contain frequency components well above the normal speech bandwidth. In some applications the audio system should be able to handle a frequency band between about 20 Hz to 20 000 kHz. The sample rate for that kind of signals should be at least 40 000 kHz to avoid aliasing. It should be noted here that the above mentioned values are just non-limiting examples. For example, in some systems the higher limit for music signals may be about 10 000 kHz or even less than that.

The sampled digital signal is then encoded, usually on a frame by frame basis, resulting in a digital data stream with a bit rate that is determined by a codec used for encoding. The higher the bit rate, the more data is encoded, which results in a more accurate representation of the input frame. The encoded audio signal can then be decoded and passed through a digital to analogue (D/A) converter to reconstruct a signal which is as near the original signal as possible.

An ideal codec will encode the audio signal with as few bits as possible thereby optimising channel capacity, while producing decoded audio signal that sounds as close to the original audio signal as possible. In practice there is usually a trade-off between the bit rate of the codec and the quality of the decoded audio.

At present there are numerous different codecs, such as the adaptive multi-rate (AMR) codec and the adaptive multi-rate wideband (AMR-WB) codec, which are developed for compressing and encoding audio signals. AMR was developed by the 3rd Generation Partnership Project (3GPP) for GSM/EDGE and WCDMA communication networks. In addition, it has also been envisaged that AMR will be used in packet switched networks. AMR is based on Algebraic Code Excited Linear Prediction (ACELP) coding. The AMR and AMR WB codecs consist of 8 and 9 active bit rates respectively and also include voice activity detection (VAD) and discontinuous transmission (DTX) functionality. At the moment, the sampling rate in the AMR codec is 8 kHz and in the AMR WB codec the sampling rate is 16 kHz. It is obvious that the codecs and sampling rates mentioned above are just non-limiting examples.

ACELP coding operates using a model of how the signal source is generated, and extracts from the signal the parameters of the model. More specifically, ACELP coding is based on a model of the human vocal system, where the throat and mouth are modelled as a linear filter and speech is generated by a periodic vibration of air exciting the filter. The speech is analysed on a frame by frame basis by the encoder and for each frame a set of parameters representing the modelled speech is generated and output by the encoder. The set of parameters may include excitation parameters and the coefficients for the filter as well as other parameters. The output from a speech encoder is often referred to as a parametric representation of the input speech signal. The set of parameters is then used by a suitably configured decoder to regenerate the input speech signal.

Transform coding is widely used in non-speech audio coding. The superiority of transform coding for non-speech signals is based on perceptual masking and frequency domain coding. Even though transform coding techniques give superior quality for audio signal the performance is not good for periodic speech signals and therefore quality of transform coded speech is usually rather low. On the other hand, speech codecs based on human speech production system usually perform poorly for audio signals.

For some input signals, the pulse-like ACELP-excitation produces higher quality and for some input signals transform coded excitation (TCX) is more optimal. It is assumed here that ACELP-excitation is mostly used for typical speech content as an input signal and TCX-excitation is mostly used for typical music and other non-speech audio as an input signal. However, this is not always the case, i.e., sometimes speech signal has parts, which are music like and music signal has parts, which are speech like. There can also exist signals containing both music and speech wherein the selected coding method may not be optional for such signals in prior art systems.

The selection of excitation can be done in several ways: the most complex and quite good method is to encode both ACELP and TCX-excitation and then select the best excitation based on the synthesised audio signal. This analysis-by-synthesis type of method will provide good results but it is in some applications not practical because of its high complexity. In this method for example SNR-type of algorithm can be used to measure the quality produced by both excitations. This method can be called as a "brute-force" method because it tries all the combinations of different excitations and selects afterwards the best one. The less complex method would perform the synthesis only once by analysing the signal properties beforehand and then selecting the best excitation. The method can also be a combination of pre-selection and "brute-force" to make compromised between quality and complexity.

FIG. 1 presents a simplified encoder 100 with prior-art high complexity classification. An audio signal is input to the input signal block 101 in which the signal is digitised and filtered. The input signal block 101 also forms frames from the digitised and filtered signal. The frames are input to a linear prediction coding (LPC) analysis block 102. It performs a LPC analysis on the digitised input signal on a frame by frame basis to find such a parameter set which matches best with the input signal. The determined parameters (LPC parameters) are quantized and output 109 from the encoder 100. The encoder 100 also generates two output signals with LPC synthesis blocks 103, 104. The first LPC synthesis block 103 uses a signal generated by the TCX excitation block 105 to synthesise the audio signal for finding the code vector producing the best result for the TCX excitation. The second LPC synthesis block 104 uses a signal generated by the ACELP excitation block 106 to synthesise the audio signal for finding the code vector producing the best result for the ACELP excitation. In the excitation selection block 107 the signals generated by the LPC synthesis blocks 103, 104 are compared to determine which one of the excitation methods gives the best (optimal) excitation. Information about the selected excitation method and parameters of the selected excitation signal are, for example, quantized and channel coded 108 before outputting 109 the signals from the encoder 100 for transmission.

SUMMARY OF THE INVENTION

One aim of the present invention is to provide an improved method for selecting a coding method for different parts of an audio signal. In the invention an algorithm is used to select a coding method among at least a first and a second coding method, for example TCX or ACELP, for encoding by open-loop manner. The selection is performed to detect the best coding model for the source signal, which does not mean the separation of speech and music. According to one embodiment of the invention an algorithm selects ACELP especially for periodic signals with high long-term correlation (e.g. voiced speech signal) and for signal transients. On the other hand, certain kind of stationary signals, noise like signals and tone like signals are encoded using transform coding to better handle the frequency resolution.

The invention is based on the idea that input signal is analysed by examining the parameters the LTP analysis produces to find e.g. transients, periodic parts etc. from the audio signal. The encoder according to the present invention is primarily characterised in that the encoder further comprises a parameter analysis block for analysing said LTP parameters, and an excitation selection block for selecting one excitation block among said first excitation block and said second excitation block for performing the excitation for the frames of the audio signal on the basis of the parameter analysis. The device according to the present invention is primarily characterised in that the device further comprises a parameter analysis block for analysing said LTP parameters, and an excitation selection block for selecting one excitation block among said first excitation block and said second excitation block for performing the excitation for the frames of the audio signal on the basis of the parameter analysis. The system according to the present invention is primarily characterised in that the system further comprises in said encoder a parameter analysis block for analysing said LTP parameters, and an excitation selection block for selecting one excitation block among said first excitation block and said second excitation block for performing the excitation for the frames of the audio signal on the basis of the parameter analysis. The method according to the present invention is primarily characterised in that the method further comprises analysing said LTP parameters, and selecting one excitation block among said at least first excitation and said second excitation for performing the excitation for the frames of the audio signal on the basis of the parameter analysis. The module according to the present invention is primarily characterised in that the module further comprises a parameter analysis block for analysing said LTP parameters, and an excitation selection block for selecting one excitation block among a first excitation block and a second excitation block, and for indicating the selected excitation method to an encoder. The computer program product according to the present invention is primarily characterised in that the computer program product further comprises machine executable steps for analysing said LTP parameters, and selecting one excitation among at least said first excitation and said second excitation for performing the excitation for the frames of the audio signal on the basis of the parameter analysis.

The present invention provides advantages when compared with prior art methods and systems. By using the classification method according to the present invention it is possible to improve reproduced sound quality without greatly affecting the compression efficiency. The invention improves especially reproduced sound quality of mixed signals, i.e. signals including both speech like and non-speech like signals.

DETAILED DESCRIPTION OF THE INVENTION

Figure 1:
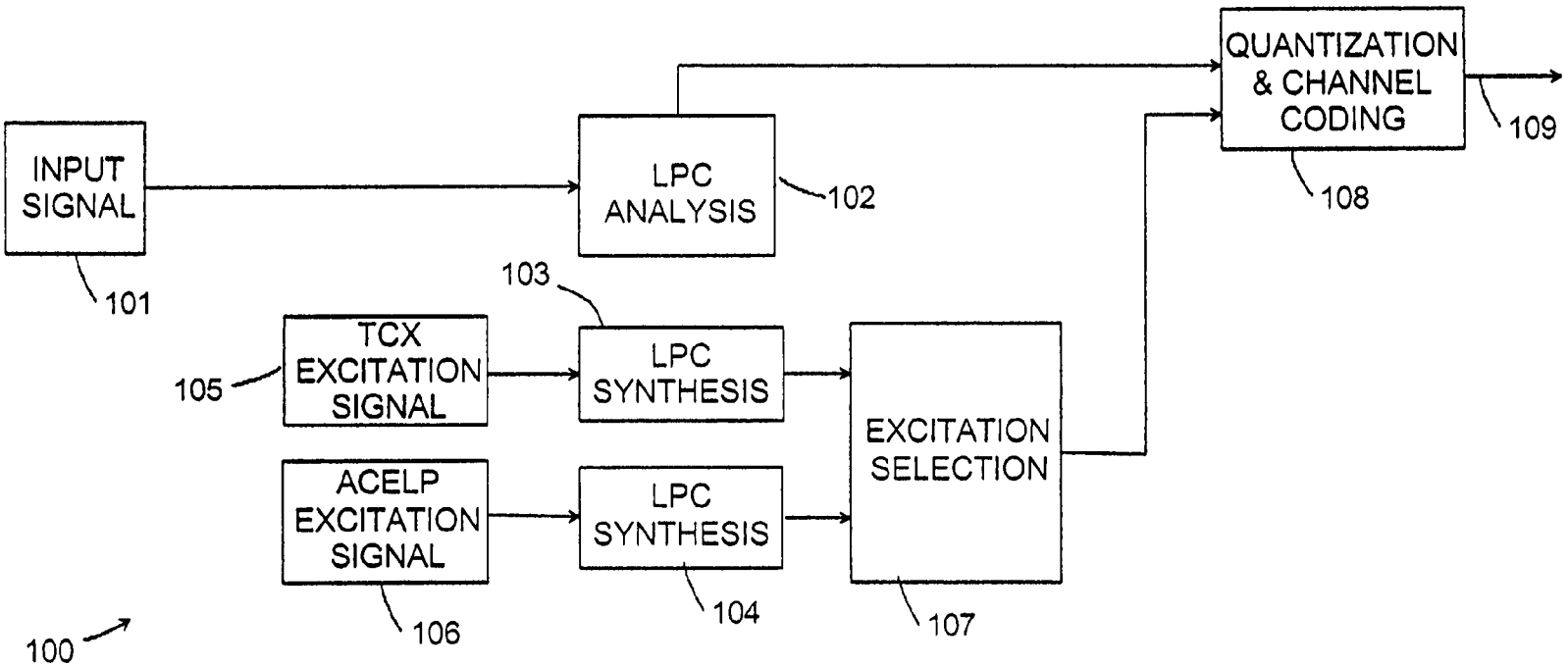
(PRIOR ART) Fig. 1
FIG. 1 presents a simplified encoder with prior-art high complexity classification.
Figure 2:
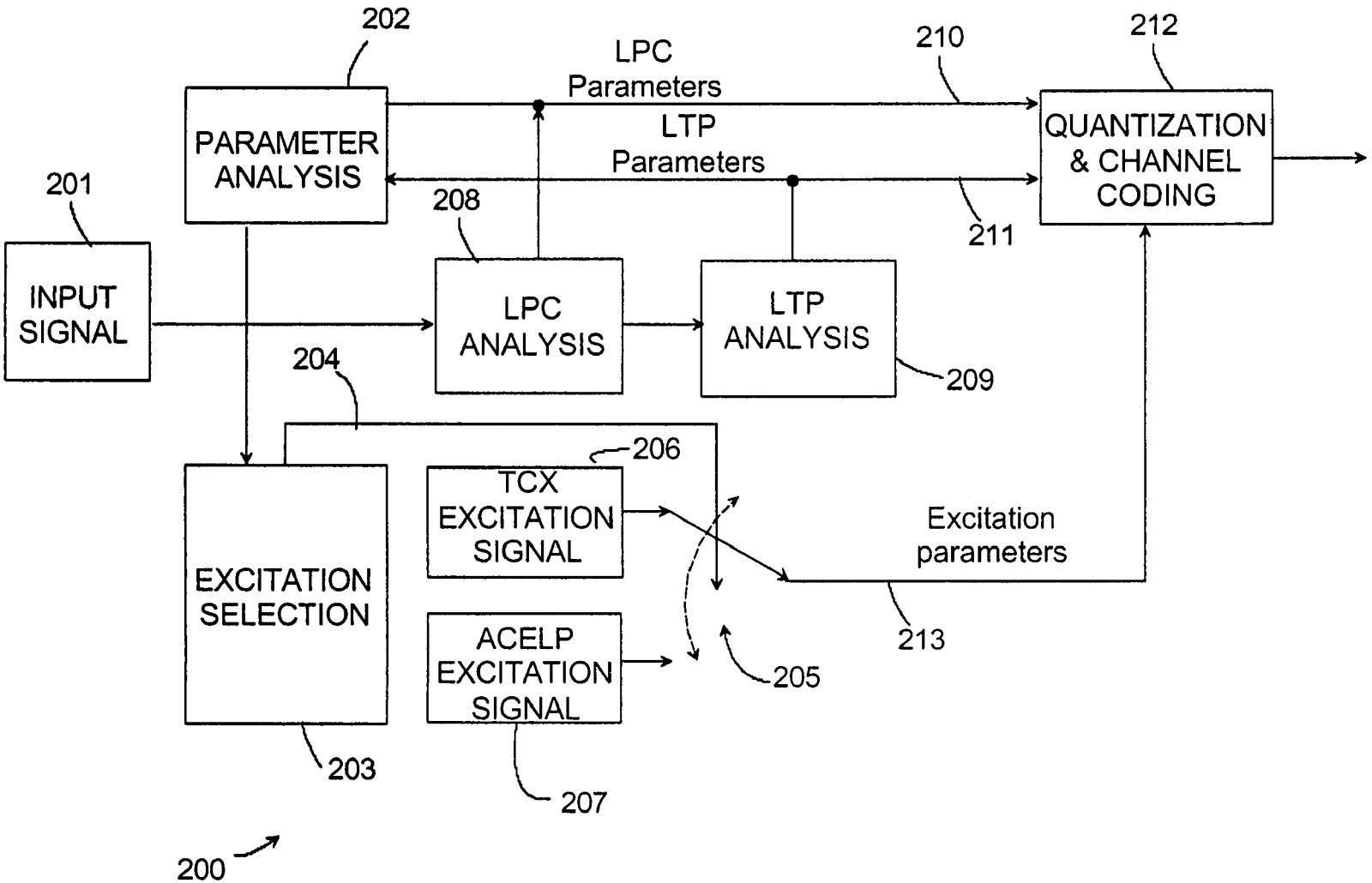
FIG. 2 presents an example embodiment of an encoder with classification according to the invention.

In the following an encoder 200 according to an example embodiment of the present invention will be described in more detail with reference to FIG. 2. The encoder 200 comprises an input block 201 for digitizing, filtering and framing the input signal when necessary. It should be noted here that the input signal may already be in a form suitable for the encoding process. For example, the input signal may have been digitised at an earlier stage and stored to a memory medium (not shown). The input signal frames are input to a LPC analysis block 208 which performs LPC analysis to the input signal and forms LPC parameters on the basis of the properties of the signal. A LTP analysis block 209 forms LTP parameters on the basis of the LPC parameters. The LPC parameters and LTP parameters are examined in a parameter analysis block 202. On the basis of the result of the analysis an excitation selection block 203 determines which excitation method is the most appropriate one for encoding the current frame of the input signal. The excitation selection block 203 produces a control signal 204 for controlling a selection means 205 according to the parameter analysis. If it was determined that the best excitation method for encoding the current frame of the input signal is a first excitation method, the selection means 205 are controlled to select the signal (excitation parameters) of a first excitation block 206 to be input to a quantisation and encoding block 212. If it was determined that the best excitation method for encoding the current frame of the input signal is a second excitation method, the selection means 205 are controlled to select the signal (exitation parameters) of a second excitation block 207 to be input to the quantisation and encoding block 212. Although the encoder of FIG. 2 has only the first 206 and the second excitation block 207 for the encoding process, it is obvious that there can also be more than two different excitation blocks for different excitation methods available in the encoder 200 to be used in the encoding of the input signal.

The first excitation block 206 produces, for example, a TCX excitation signal (vector) and the second excitation block 207 produces, for example, a ACELP excitation signal (vector). It is also possible that the selected excitation block 206, 207 first try two or more excitation vectors wherein the vector which produces the most compact result is selected for transmission. The determination of the most compact result may be made, for example, on the basis of the number of bits to be transmitted or the coding error (the difference between the synthesised audio and the real audio input).

Figure 6:
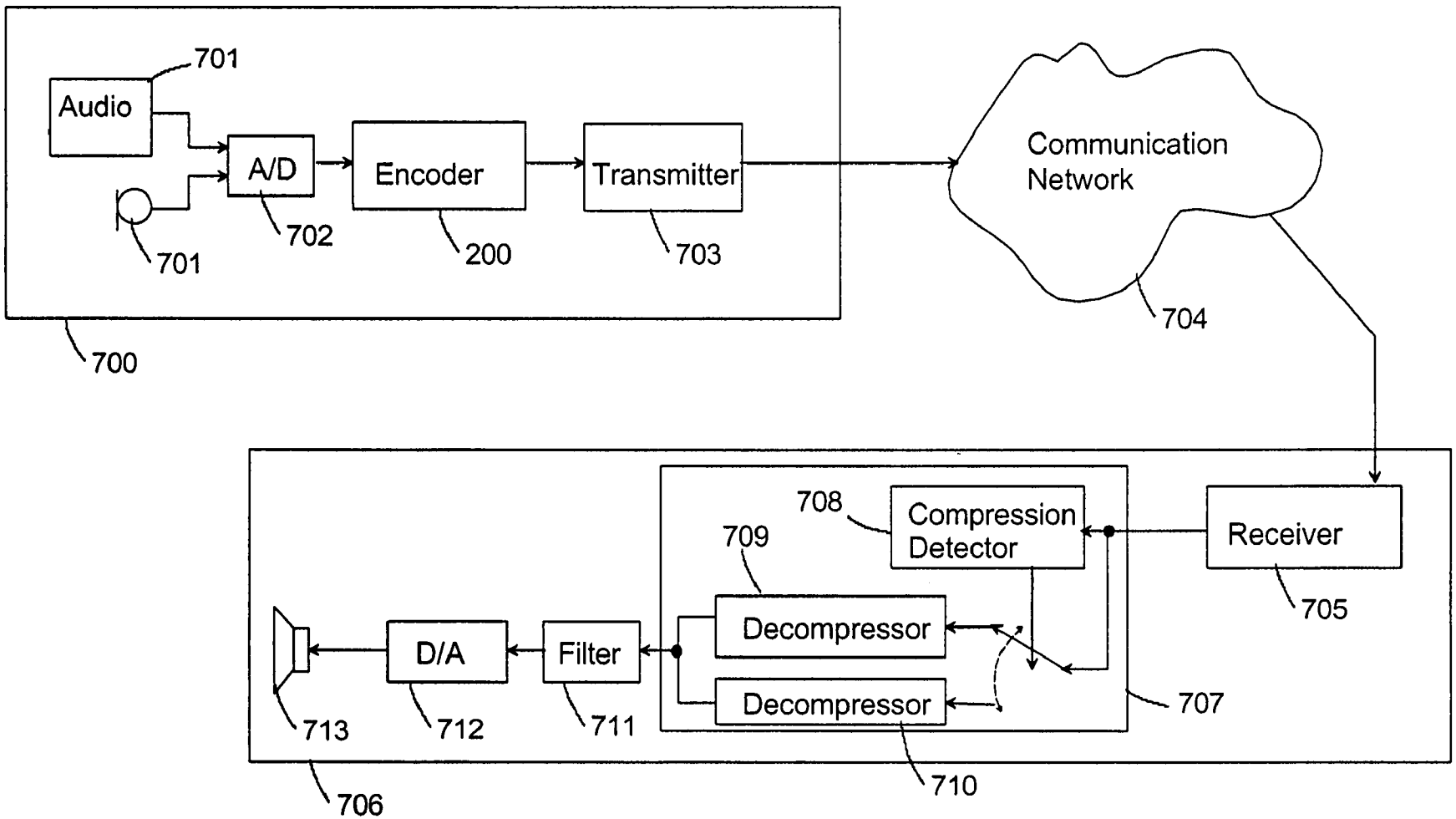
FIG. 6 shows an example of a system according to the present invention.

LPC parameters 210, LTP parameters 211 and excitation parameters 213 are, for example, quantised and encoded in the quantisation and encoding block 212 before transmission e.g. to a communication network 704 (FIG. 6). However, it is not necessary to transmit the parameters but they can, for example, be stored on a storage medium and at a later stage retrieved for transmission and/or decoding.

In an extended AMR-WB (AMR-WB+) codec, there are two types of excitation for LP-synthesis: ACELP pulse-like excitation and transform coded TCX-excitation. ACELP excitation is the same than used already in the original 3GPP AMR-WB standard (3GPP TS 26.190) and TCX-excitation is the essential improvement implemented in the extended AMR-WB.

In AMR-WB+ codec, linear prediction coding (LPC) is calculated in each frame to model the spectral envelope. The LPC excitation (the output of the LP filter of the coded) is either coded by algebraic code excitation linear prediction (ACELP) type or transform coding based algorithm (TCX). As an example, ACELP performs LTP and fixed codebook parameters for LPC excitation. For example, the transform coding (TCX) of AMR-WB+ exploits FFT (Fast Fourier transform). In AMR-WB+ codec the TCX coding can be done by using one of three different frame lengths (20, 40 and 80 ms).

In the following an example of a method according to the present invention will be described in more detail. In the method an algorithm is used to determine some properties of the audio signal such as periodicity and pitch. Pitch is a fundamental property of voiced speech. For voiced speech, the glottis opens and closes in a periodic fashion, imparting periodic character to the excitation. Pitch period, T0, is the time span between sequential openings of glottis. Voiced speech segments have especially strong long-term correlation. This correlation is due to the vibrations of the vocal cords, which usually have a pitch period in the range from 2 to 20 ms.

LTP parameters lag and gain are calculated for the LPC residual. The LTP lag is closely related to the fundamental frequency of the speech signal and it is often referred to as a "pitch-lag" parameter, "pitch delay" parameter or "lag", which describes the periodicity of the speech signal in terms of speech samples. The pitch-delay parameter can be calculated by using an adaptive codebook. Open-loop pitch analysis can be done to estimate the pitch lag. This is done in order to simplify the pitch analysis and confine the closed loop pitch search to a small number of lags around the open-loop estimated lags. Another LTP parameter related to the fundamental frequency is the gain, also called LTP gain. The LTP gain is an important parameter together with LTP lag which are used to give a natural representation of the speech.

Stationary properties of the source signal is analysed by e.g. normalised correlation, which can be calculated as follows:

$$NormCorr = \sum_{i=0}^{N-1} \frac{x_{i-T0} * x_i}{\sqrt{x_{i-T0}} * \sqrt{x_i}}, \quad (1)$$

where T0 is the open-loop lag of the frame having a length N. $X_i$ is the ith sample of the encoded frame. $X_i$-T0 is the sample from recently encoded frame, which is T0 samples back in the past from the sample $X_i$.

Figure 3:
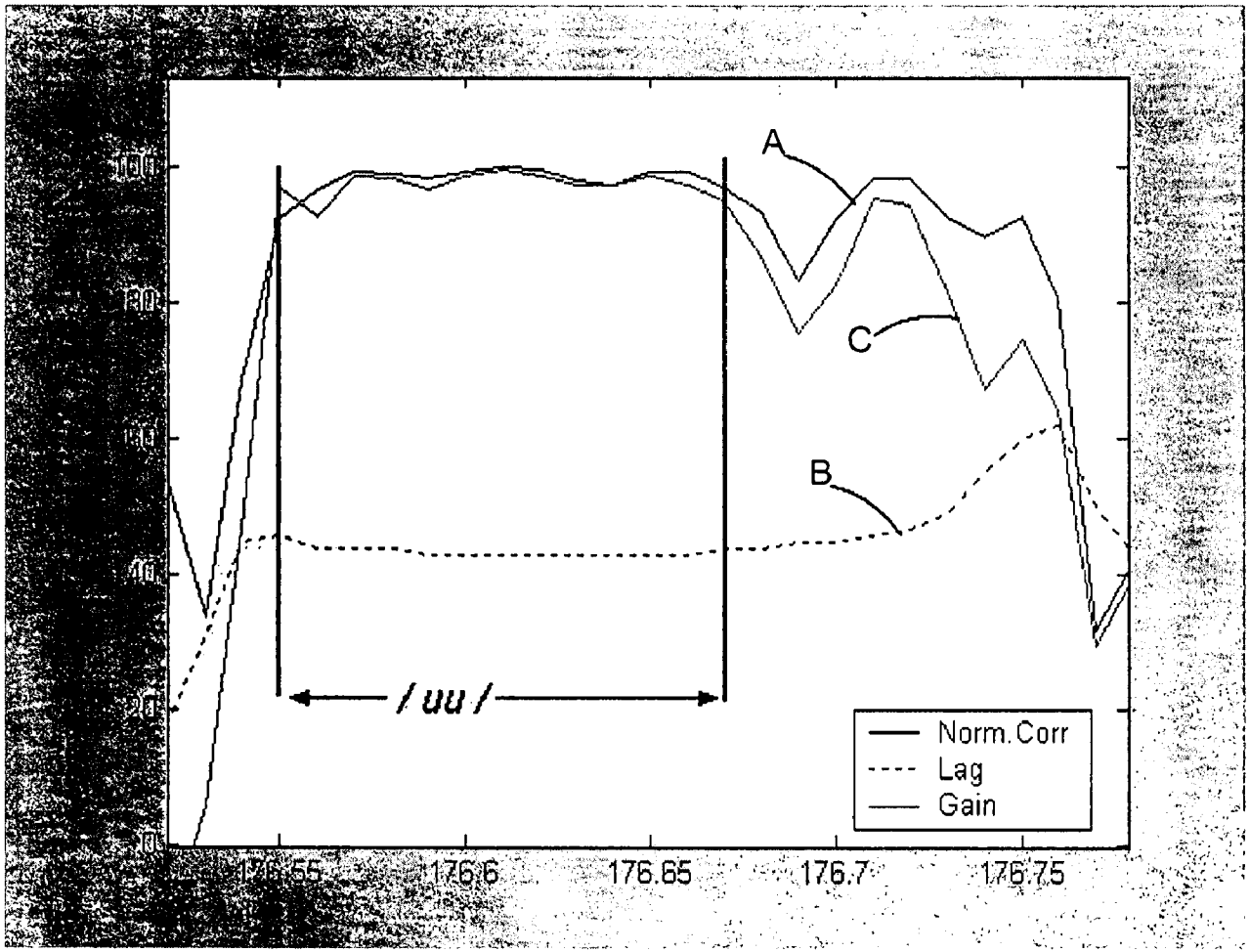
FIG. 3 shows scaled normalised correlation, lag and scaled gain parameters of an example of a voiced speech sequence.
Figure 4:
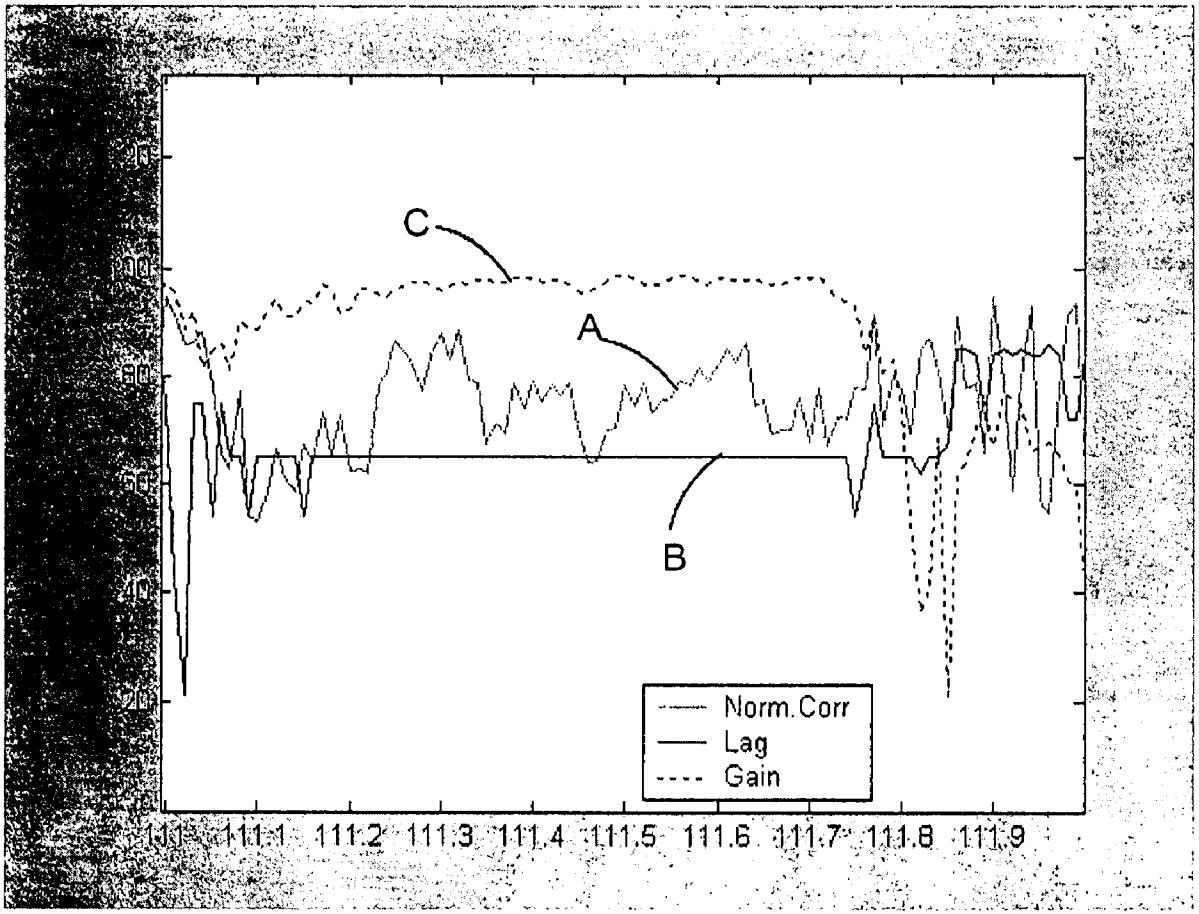
FIG. 4 shows scaled normalised correlation, lag and scaled gain parameters of an example of an audio signal containing sound of a single instrument, FIG. 5 Scaled normalised correlation, lag and scaled gain of a an example of an audio signal containing music with several instruments.
Figure 5:
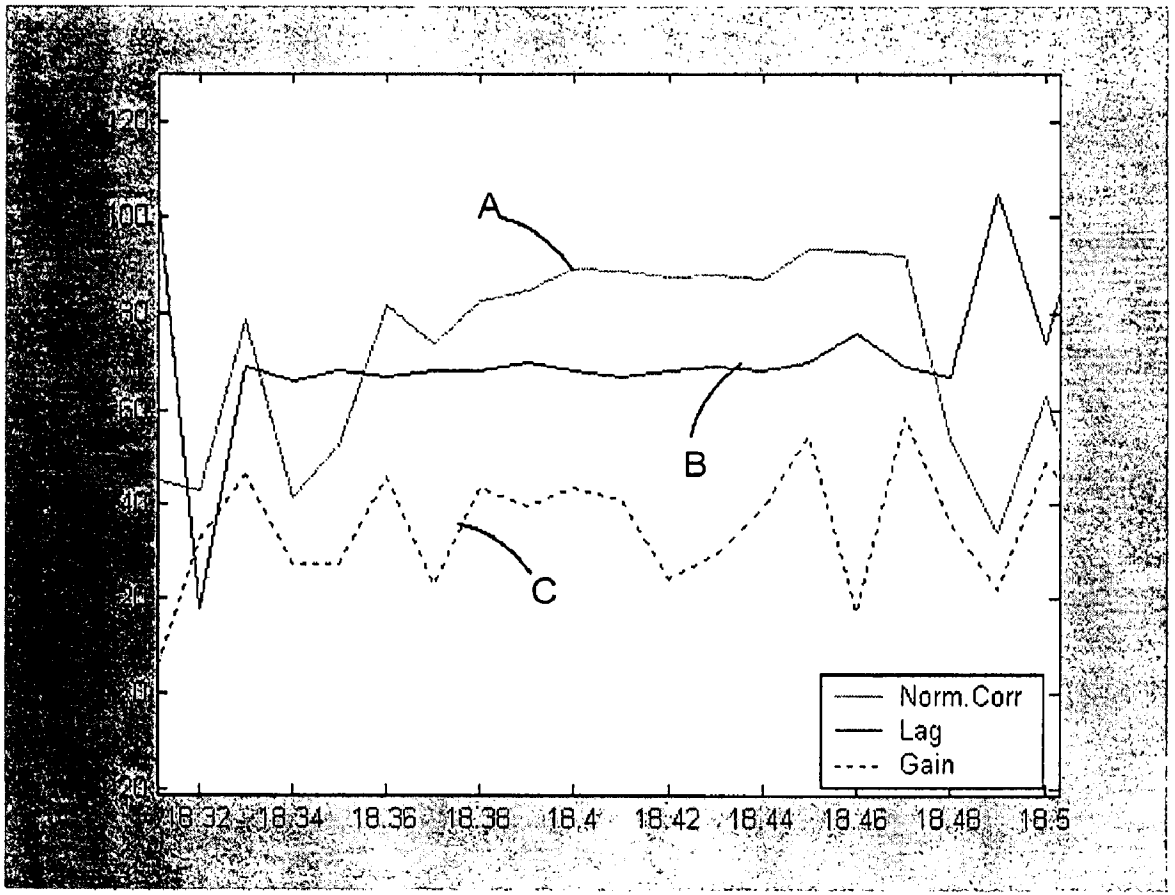

A few examples of LTP parameter characteristics as a function of time can be seen in FIGS. 3, 4 and 5. In the figures the curve A shows a normalised correlation of the signal, the curve B shows the lag and the curve C shows the scaled gain. The normalised correlation and the LTP gain are scaled (multiplied by 100) so that they can fit in the same figure with the LTP lag. In FIGS. 3, 4 and 5, also LTP lag values are divided by 2. As an example, a voiced speech segment (FIG. 3) includes high LTP gain and stable LTP lag. Also normalised correlation and LTP gain of the voiced speech segments are matching and therefore having high correlation. The method according to the invention classify this kind of signal segment so that the selected coding method is the ACELP (the first coding method). If LTP lag contour (composed by current and previous lags) is stable, but the LTP gain is low or unstable and/or the LTP gain and the normalised correlation have a small correlation, the selected coding method is the TCX (the second coding method). This kind of situation is illustrated in the example of FIG. 4 in which parameters of an audio signal of one instrument (saxophone) are shown. If the LTP lag contour of current and previous frames is very unstable, the selected coding method is also in this case the TCX. This is illustrated in the example of FIG. 5 in which parameters of an audio signal of a multiplicity of instruments are shown. The word stable means here that e.g. the difference between minimum and maximum lag values of current and previous frames is below some predetermined threshold (a second threshold TH2). Therefore, the lag is not changing much in current and previous frames. In AMR-WB+ codec, the range of LTP gain is between 0 and 1.2. The range of the normalised correlation is between 0 and 1.0. As an example, the threshold indicating high LTP gain could be over 0.8. High correlation (or similarity) of the LTP gain and normalised correlation can be observed e.g. by their difference. If the difference is below a third threshold TH3, for example, 0.1 in current and/or past frames, LTP gain and normalised correlation have a high correlation.

If the signal is transient in nature, it is coded by a first coding method, for example, by the ACELP coding method, in an example embodiment of the present invention. Transient sequences can be detected by using spectral distance SD of adjacent frames. For example, if spectral distance, $SD_n$, of the frame n calculated from immittance spectrum pair (ISP) coefficients (LP filter coefficients converted to the ISP representation) in current and previous frame exceeds a predetermined first threshold TH1, the signal is classified as transient. Spectral distance $SD_n$ can be calculated from ISP parameters as follows:

$$SD(n) = \sum_{i=0}^{N-1} |ISP_n(i) - ISP_{n-1}(i)| \quad (2)$$

where $ISP_n$ is the ISP coefficients vector of the frame n and $ISP_n(i)$ is the ith element of it.

Noise like sequences are coded by a second coding method, for example, by transform coding TCX. These sequences can be detected by LTP parameters and average frequency along the frame in frequency domain. If the LTP parameters are very unstable and/or average frequency exceeds a predetermined threshold TH16, it is determined in the method that the frame contains noise like signal.

An example algorithm for the classifying process according to the present invention is described below. The algorithm can be used in the encoder 200 such as an encoder of the AMR WB+ codec.

```
if (SD_n > TH1)
    Mode = ACELP_MODE;
else
    if (LagDif_buf < TH2)
        if (Lag_n == HIGH LIMIT or Lag_n == LOW LIMIT){
            if (Gain_n-NormCorr_n<TH3 and NormCorr_n>TH4)
                Mode = ACELP_MODE
            else
                Mode = TCX_MODE
    else if (Gain_n- NormCorr_n < TH3 and NormCorr_n > TH5)
        Mode = ACELP_MODE
    else if (Gain_n - NormCorr_n > TH6)
        Mode = TCX_MODE
    else
        NoMtcx = NoMtcx +1
if (MaxEnergy_buf < TH7)
    if (SD_n > TH8)
        Mode = ACELP_MODE;
    else
        NoMtcx = NoMtcx +1
if (LagDif_buf < TH2)
    if (NormCorr_n < TH9 and SD_n < TH10)
        Mode = TCX_MODE;
if (lph_n > TH11 and SD_n < TH10)
    Mode = TCX_MODE
if (vadFlag_old == 0 and vadFlag == 1 and Mode == TCX_MODE))
    NoMtcx = NoMtcx +1
if (Gain_n - NormCorr_n < TH12 and NormCorr_n > TH13 and Lag_n > TH14)
    DFTSum = 0;
    for (i=1; i<NO_of_elements; i++) { /*First element left out*/
        DFTSum = DFTSum + mag[i];
    if (DFTSum > TH15 and mag[0] < TH16) {
        Mode = TCX_MODE;
    else
        Mode = ACELP_MODE;
        NoMtcx = NoMtcx +1
```

The algorithm above contains some thresholds TH1-TH15 and constants HIGH_LIMIT, LOW_LIMIT, Buflimit, NO_of_elements. In the following some example values for the thresholds and constants are shown but it is obvious that the values are non-limiting examples only.

TH1=0.2
TH2=2
TH3=0.1
TH4=0.9
TH5=0.88
TH6=0.2
TH7=60
TH8=0.15
TH9=0.80

TH10=0.1
TH11=200
TH12=0.006
TH13=0.92
TH14=21
TH15=95
TH16=5
NO_of_elements=40
HIGH_LIMIT=115
LOW_LIMIT=18

The meaning of the variables of the algorithm are as follows: HIGH_LIMIT and LOW_LIMIT relate to the maximum and minimum LTP lag values, respectively, $LagDif_{buf}$ is the buffer containing LTP lags from current and previous frames. $Lag_n$ is one or more LTP lag values of the current frame (two open loop lag values are calculated in a frame in AMR WB+ codec). $Gain_n$ is one or more LTP gain values of the current frame. $NormCorr_n$ is one or more normalised correlation values of the current frame. $MaxEnergy_{buf}$ is the maximum value of the buffer containing energy values of current and previous frames. $Iph_n$ indicates the spectral tilt, $vadFlag_{old}$ is the VAD flag of the previous frame and vadFlag is the VAD flag of the current frame. NoMtcx is the flag indicating to avoid TCX transformation with long frame length (e.g. 80 ms), if the second coding model TCX is selected. Mag is a discrete Fourier transformed (DFT) spectral envelope created from LP filter coefficients, Ap, of the current frame which can be calculated according to the following program code:

```
for (i=0; i<DFTN*2; i++)
    cos_t[i] = cos[i*N_MAX/(DFTN*2)]
    sin_t[i] = sin[i*N_MAX/(DFTN*2)]
for (i=0; i<LPC_N; i++)
    ip[i] = Ap[i]
mag[0] = 0.0;
for (i=0; i<DFTN; i++)          /* calc DFT */
    x = y = 0
    for (j=0; j<LPC_N; j++) x = x + ip[j]*cos_t[(i*j)&(DFTN*2-1)]
        y = y + ip[j]*sin_t[(i*j)&(DFTN*2-1)]
    Mag[i] = 1/sqrt(x*x+y*y)
```

where DFTN=62, N_MAX=1152, LPC_N=16. The vectors cos and sin contain the values of cosine and sinusoidal functions respectively. The length of vectors cos and sin is 1152. DFTSum is the sum of first NO_of_elements (e.g. 40) elements of the vector mag, excluding the very first element (mag(0)) of the vector mag.

In the description above, AMR-WB extension (AMR-WB+) was used as a practical example of an encoder. However, the invention is not limited to AMR-WB codecs or ACELP- and TCX-excitation methods.

Although the invention was presented above by using two different excitation methods it is possible to use more than two different excitation methods and make the selection among them for compressing audio signals.

FIG. 6 depicts an example of a system in which the present invention can be applied. The system comprises one or more audio sources 701 producing speech and/or non-speech audio signals. The audio signals are converted into digital signals by an A/D-converter 702 when necessary. The digitized signals are input to an encoder 200 of a transmitting device 700 in which the compression is performed according to the present invention. The compressed signals are also quantized and encoded for transmission in the encoder 200 when necessary. A transmitter 703, for example a transmitter of a mobile communications device 700, transmits the compressed and encoded signals to a communication network 704. The signals are received from the communication network 704 by a receiver 705 of a receiving device 706. The received signals are transferred from the receiver 705 to a decoder 707 for processing, e.g., for decoding, dequantization and decompression. The decoder 707 comprises detection means 708 to determine the compression method used in the encoder 200 for a current frame. The decoder 707 selects on the basis of the determination a first decompression means 709 or a second decompression means 710 for decompressing the current frame. The decompressed signals are connected from the decompression means 709, 710 to a filter 711 and a D/A converter 712 for converting the digital signal into analog signal. The analog signal can then be transformed to audio (an acoustic signal), for example, in a loudspeaker 713.

The present invention can be implemented in different kind of systems, especially in low-rate transmission for achieving more efficient compression and/or improved audio quality for the reproduced (decompressed/decoded) audio signal than in prior art systems especially in situations in which the audio signal includes both speech like signals and non-speech like signals (e.g. mixed speech and music). The encoder 200 according to the present invention can be implemented in different parts of communication systems. For example, the encoder 200 can be implemented in a mobile communication device having limited processing capabilities.

The invention can also be implemented as a module 202, 203 which can be connected with an encoder to analyse the parameters and to control the selection of the excitation method for the encoder 200.

It is obvious that the present invention is not solely limited to the above described embodiments but it can be modified within the scope of the appended claims.

The invention claimed is:

1. An apparatus, comprising:

an input unit, configured to receive frames of an audio signal, a long term prediction analysis block, configured to perform a long term prediction analysis on the frames of the audio signal and to form long term prediction parameters based on properties of the audio signal, a first excitation block, configured to perform a first excitation for frames of the audio signal, a second excitation block, configured to perform a second excitation for frames of the audio signal, a parameter analysis block, configured to analyze said long term prediction parameters, and an excitation selection block, configured to select, based on the parameter analysis by said parameter analysis block, one excitation block among said first excitation block and said second excitation block for performing the excitation for encoding the frames of the audio signal.

2. The apparatus according to claim 1, wherein said parameter analysis block is further configured to calculate a normalized correlation based at least on the long term prediction parameters.

3. The apparatus according to claim 1, wherein said long term prediction parameters comprise at least a lag and a gain.

4. The apparatus according to claim 1, wherein said first excitation is an Algebraic Code Excited Linear Prediction excitation and said second excitation is a transform coded excitation.

5. The apparatus according to claim 1, wherein said apparatus is an adaptive multi-rate wideband codec.

6. The apparatus according to claim 5, wherein said long term prediction analysis block is an long term prediction analysis block of the adaptive multi-rate wideband codec.

7. The apparatus according to claim 1, wherein said parameter analysis block is further configured to examine at least one of the following properties of the audio signal: signal transients, noise like signals, stationary signals, periodic signals, stationary and periodic signals.

8. The apparatus according to claim 7, wherein a noise is determined based on said long term prediction parameters being unstable, or an average frequency exceeding a predetermined threshold, or both.

9. The apparatus according to claim 7, wherein stationary and periodic signals are determined based on a substantially high long term prediction gain and a substantially stable long term prediction lag and a normalized correlation.

10. A device comprising an encoder, said encoder comprising:

an input unit, configured to receive frames of an audio signal, a long term prediction analysis block, configured to perform a long term prediction analysis on the frames of the audio signal and to form long term prediction parameters based on properties of the audio signal, a first excitation block, configured to perform a first excitation for frames of the audio signal, a second excitation block, configured to perform a second excitation for frames of the audio signal, a parameter analysis block, configured to analyze said long term prediction parameters, and an excitation selection block, configured to select, based on the parameter analysis by said parameter analysis block, one excitation block among said first excitation block and said second excitation block for performing the excitation for encoding the frames of the audio signal.

11. The device according to claim 10, wherein said parameter analysis block is further configured to calculate a normalized correlation at least based on the long term prediction parameters.

12. The device according to claim 10, wherein said long term prediction parameters comprise at least a lag and a gain.

13. The device according to claim 10, wherein said first excitation is an Algebraic Code Excited Linear Prediction excitation and said second excitation is a transform coded excitation.

14. The device according to claim 10, wherein said encoder is an adaptive multi-rate wideband codec.

15. The device according to claim 14, wherein said long term prediction analysis block is a long term prediction analysis block of the adaptive multi-rate wideband codec.

16. The device according to claim 10, wherein said parameter analysis block is further configured to examine at least one of the following properties of the audio signal: signal transients, noise like signals, stationary signals, periodic signals, stationary and periodic signals.

17. The device according to claim 16, wherein a noise is determined based on said long term prediction parameters being unstable, or an average frequency exceeding a predetermined threshold, or both.

18. The device according to claim 16, wherein stationary and periodic signals are determined based on a substantially high long term prediction gain and a substantially stable long term prediction lag and a normalized correlation.

19. A system comprising an encoder, said encoder comprising:

an input unit, configured to receive frames of an audio signal, a long term prediction analysis block, configured to perform a long term prediction analysis on the frames of the audio signal and to form long term prediction parameters based on the properties of the audio signal, a first excitation block, configured to perform a first excitation for frames of the audio signal, a second excitation block, configured to perform a second excitation for frames of the audio signal, a parameter analysis block, configured to analyze said long term prediction parameters, and an excitation selection block, configured to select, based on the parameter analysis by said parameter analysis block, one excitation block among said first excitation block and said second excitation block for performing the excitation for encoding the frames of the audio signal.

20. The system according to claim 19, wherein said parameter analysis block is further configured to calculate a normalized correlation at least based on the long term prediction parameters.

21. The system according to claim 19, wherein said long term prediction parameters comprise at least a lag and a gain.

22. The system according to claim 19, wherein said first excitation is an Algebraic Code Excited Linear Prediction excitation and said second excitation is a transform coded excitation.

23. The system according to claim 19, wherein said encoder is an adaptive multi-rate wideband codec.

24. The system according to claim 23, wherein said long term prediction analysis block is an long term prediction analysis block of the adaptive multi-rate wideband codec.

25. The system of claim 19, wherein said encoder further comprises:

a transmitter, configured to transmit compressed signals to a communication network, and wherein said system further comprises:

a receiving device, configured to receive the compressed signals from the communication network for processing by said receiving device.

26. The system of claim 25, wherein said receiving device comprises a receiver, said receiver is configured to transfer the compressed signals to a device for decompressing said compressed signals, wherein said device is configured to determine a decompression method used in said encoder for a current frame and select a decompression method among a first decompression method or a second decompression method for decompressing the current frame, and provide decompressed signals to a filter and a digital-to-analog converter for conversion to an analog signal for transformation to an acoustic signal.

27. The system according to claim 19, wherein said parameter analysis block is further configured to examine at least one of the following properties of the audio signal: signal transients, noise like signals, stationary signals, periodic signals, stationary and periodic signals.

28. The system according to claim 27, wherein a noise is determined based on said long term prediction parameters being unstable, or an average frequency exceeding a predetermined threshold, or both.

29. The system according to claim 27, wherein stationary and periodic signals are determined based on a substantially high long term prediction gain and a substantially stable long term prediction lag and a normalized correlation.

30. A method, comprising:

receiving frames of an audio signal in an apparatus, said apparatus performing a long term prediction analysis on the frames of the audio signal for forming long term prediction parameters based on properties of the audio signal, said apparatus analyzing said long term prediction parameters, and said apparatus based on the analysis of the long term prediction parameters, selecting one excitation method among a first excitation method and a second excitation method for performing an excitation for encoding the frames of the audio signal.

31. The method according to claim 30, wherein analyzing said long term prediction parameters comprises said apparatus calculating a normalized correlation at least based on the long term prediction parameters.

32. The method according to claim 30, wherein said long term prediction parameters comprise at least a lag and a gain.

33. The method according to claim 30, wherein said first excitation is an Algebraic Code Excited Linear Prediction excitation and said second excitation is a transform coded excitation.

34. The method according to claim 30, wherein in analyzing said long term prediction parameters, at least one of the following properties of the audio signal is examined by said apparatus: signal transients, noise like signals, stationary signals, periodic signals, stationary and periodic signals.

35. The method according to claim 34, wherein a noise is determined by said apparatus based on said long term prediction parameters being unstable, or an average frequency exceeding a predetermined threshold, or both.

36. The method according to claim 34, wherein stationary and periodic signals are determined by said apparatus based on a substantially high long term prediction gain and a substantially stable long term prediction lag and a normalized correlation.

37. A device, comprising:

a long term prediction analysis block, configured to perform a long term prediction analysis on frames of an audio signal to form long term prediction parameters based on properties of the audio signal, a parameter analysis block, configured to analyze said long term prediction parameters, and an excitation selection block, configured to select one excitation block among a first excitation block and a second excitation block, and for indicating a selected excitation block to an encoder, wherein said frames of the audio signal are encoded by the encoder using excitation parameters output by the selected excitation block.

38. The device according to claim 37, wherein said parameter analysis block is further configured to calculate a normalized correlation based at least on the long term prediction parameters.

39. The device according to claim 37, wherein said long term prediction parameters comprise at least a lag and a gain.

40. The device according to claim 37, wherein said first excitation is an Algebraic Code Excited Linear Prediction excitation and said second excitation is a transform coded excitation.

41. The device according to claim 37, wherein said encoder is an adaptive multi-rate wideband codec.

42. The device according to claim 41, wherein said long term prediction analysis block is an long term prediction analysis block of the adaptive multi-rate wideband codec.

43. The device according to claim 37, wherein said parameter analysis block is further configured to examine at least one of the following properties of the audio signal: signal transients, noise like signals, stationary signals, periodic signals, stationary and periodic signals.

44. The device according to claim 43, wherein a noise is determined based on said long term prediction parameters being unstable, or an average frequency exceeding a predetermined threshold, or both.

45. The device according to claim 43, wherein stationary and periodic signals are determined based on a substantially high long term prediction gain and a substantially stable long term prediction lag and a normalized correlation.

46. A computer readable storage medium stored with code thereon for use by an encoder, which when executed by a processor, causes the encoder to perform:

receiving frames of an audio signal, performing a long term prediction analysis to frames of the audio signal and forming long term prediction parameters based on properties of the signal, analyzing said long term prediction parameters, and selecting, based on the analysis of said long term prediction parameters, one excitation method among a first excitation method and a second excitation method for performing an excitation for encoding the frames of the audio signal.

47. The computer program product according to claim 46, wherein when said code is executed by said encoder, it further causes the processor to perform an Algebraic Code Excited Linear Prediction excitation as said first excitation method, and a transform coded excitation as said second excitation method.

48. The computer readable storage medium according to claim 46, wherein when said code is executed by said processor, it further causes the encoder to perform:

examining at least one of the following properties of the audio signal: signal transients, noise like signals, stationary signals, periodic signals, stationary and periodic signals.

49. The computer readable storage medium according to claim 48, wherein when said code is executed by said processor, it further causes the encoder to perform:

examining stability of the long term prediction parameters, or for comparing an average frequency with a predetermined threshold to determine a noise on the audio signal, or both.

50. The computer readable storage medium according to claim 46, wherein when said code is executed by said processor, it further causes the encoder to perform:

calculating a normalized correlation based at least on the long term prediction parameters.

51. The computer readable storage medium according to claim 50, wherein said long term prediction parameters comprise at least a lag and a gain.

52. The computer readable storage medium according to claim 51, wherein when said code is executed by said processor, it further causes the encoder to perform:

examining stability of the lag and normalized correlation, and comparing the gain with a threshold to determine stationarity and periodicity of the audio signal.

* * * * *